US006866118B1

(12) United States Patent
Battenberg

(10) Patent No.: US 6,866,118 B1
(45) Date of Patent: Mar. 15, 2005

(54) MOTORIZED ACCESS APPARATUS FOR ELEVATED AREAS

(76) Inventor: William D. Battenberg, 4715 S. Farm Rd. 141, Springfield, MO (US) 65810-1533

( * ) Notice: Subject to any disclaimer, the term of this patent is extended or adjusted under 35 U.S.C. 154(b) by 0 days.

(21) Appl. No.: 10/871,982

(22) Filed: Jun. 21, 2004

Related U.S. Application Data

(63) Continuation-in-part of application No. 10/670,202, filed on Sep. 26, 2003.
(60) Provisional application No. 60/466,592, filed on Apr. 30, 2003.

(51) Int. Cl.[7] ..... E06C 9/00
(52) U.S. Cl. ..... 182/77; 182/78
(58) Field of Search ..... 182/77, 78, 79, 182/80, 81, 98, 163, 209; 49/141

(56) References Cited

U.S. PATENT DOCUMENTS

| | | | | | |
|---|---|---|---|---|---|
| 1,423,104 | A | | 7/1922 | Glasser | |
| 1,802,401 | A | * | 4/1931 | Bessler | 182/79 |
| 1,811,708 | A | * | 6/1931 | Bessler | 182/78 |
| 1,811,820 | A | * | 6/1931 | Bessler | 182/78 |
| 1,867,904 | A | * | 7/1932 | Bessler | 182/78 |
| 1,930,992 | A | | 10/1933 | Bessler | |
| 2,840,289 | A | * | 6/1958 | Joseph | 182/77 |
| 2,931,456 | A | | 4/1960 | Harmon | |
| 3,789,955 | A | | 2/1974 | Knapp | |
| 4,286,508 | A | | 9/1981 | Seebo, II | |
| 5,033,584 | A | | 7/1991 | Battle | |
| 5,111,906 | A | | 5/1992 | Abadia | |
| 6,802,392 | B1 | * | 10/2004 | Davis | 182/77 |
| 2001/0030081 | A1 | | 10/2001 | Morimoto et al. | |

* cited by examiner

*Primary Examiner*—Hugh B. Thompson, II
(74) *Attorney, Agent, or Firm*—Donald R. Schoonover

(57) ABSTRACT

A ladder apparatus for providing access to an area over an elevated structure, the ladder apparatus including a housing secured to the elevated structure; a ladder pivotally mounted to the housing, the ladder means including an upper ladder section and at least one lower ladder section mounted to the upper ladder section; and a motorized deploying mechanism structured to controllably allow the ladder apparatus to be pivotally and gravitationally deployed from a stowed configuration to a partially deployed configuration, controllably allow the at least one lower ladder section to be longitudinally and gravitationally deployed from the partially deployed configuration to a fully deployed configuration, longitudinally retract the at least one lower ladder section from the fully deployed configuration to the partially deployed configuration, and pivotally retract the ladder apparatus from the partially deployed configuration to the stowed configuration. A control mechanism operatively controls the motorized deploying mechanism. A power source provides electrical energy to the motorized deploying mechanism and to the control mechanism.

14 Claims, 3 Drawing Sheets

MOTORIZED ACCESS APPARATUS FOR ELEVATED AREAS

CROSS-REFERENCE TO RELATED APPLICATIONS

This application is a continuation-in-part of patent application Ser. No. 10/670,202 filed Sep. 26, 2003, which is based on Provisional Patent Application No. 60/466,592 filed Apr. 30, 2003.

BACKGROUND OF THE INVENTION

1. Field of the Invention

The present invention is related to ladders and, more specifically without limitation, to access ladders.

2. Discussion of the Related Art

Regardless of the amount of space available for storage purposes, rarely is there enough space as desired for such purposes. As a result, various means have been developed to utilize otherwise inaccessible space for storage. For example, means such as pull-down stairs have been developed to provide access to space in attics and over garage ceilings. Such spaces generally provide excellent storage for seldom used articles and seasonal items, such as Christmas decorations and the like.

Unfortunately, most of the pull-down stairs available in the marketplace are constructed of wood and are limited in load capacity. Such pull-down stairs are generally manually extendable from a folded, storage configuration by pulling on a cord hanging down from one end of the stairs. As a result, these prior art pull-down stairs are difficult to handle and are somewhat dangerous, particularly for elderly or handicapped users. Also, if such pull-down stairs are not properly installed such that the joints between the sections of the stairs assume snug abutting engagements therebetween and/or the ends of the bottom section of the stairs are not accurately coped to conform to the underlying floor when the access stairs are pulled down from its storage position, a dangerous situation is created.

Previously, most garages or areas having available space thereabove had eight-foot high ceilings. More recently, many garages having available space thereabove have ceiling heights that are substantially greater than eight feet. As a result, it is not uncommon for pull-down stairs designed for eight- or ten-foot high ceilings to be installed in garages having ceilings substantially greater than ten feet. In that event, the end of the too-short access stairs is placed on a box, crate or other precarious support. A user then undertakes the very risky procedure of mounting the relatively unstable access stairs from a nearby step stool or of taking an extremely large step in order to mount the bottom step of the access stairs.

Some existing prior art access stairs have been developed wherein the stair portion thereof is extended and retracted by some type of powered arrangement. Unfortunately, the stair portion of most such prior art powered access stairs comprises a single stair section. As a result, substantial head room is required to accommodate the stair section as it is being displaced to a storage configuration above the ceiling, which not only limits the use of such powered access stairs to applications that have the necessary substantial head room but also diminishes the amount of space remaining for storage purposes.

What is needed is a motorized access ladder that has sections that do not fold for storage purposes, that does not require substantial head room when assuming a storage configuration, that provides access not only to areas over eight- or ten-foot high ceilings but also provides access to areas over ceilings or areas that have heights substantially greater than eight feet, that has feet that abuttingly engage a solid underlying surface regardless of the area height, and that is safe for all users as well as elderly and handicapped users.

SUMMARY OF THE INVENTION

The improvement of the motorized ladder apparatus of the present invention for providing access to an area over an elevated structure includes a housing means secured to the elevated structure, the housing means having a proximal end, a distal end, opposing sides, a central opening disposed between the proximal and distal ends and opposing sides, and a cover member pivotally connected to the proximal end of the housing mechanism and dimensioned to cover the central opening as the apparatus assumes a stowed configuration; a ladder means including an upper ladder section having a first upper surface, a first lower surface, a first proximal end, a first distal end, and opposing side rails; and at least one lower ladder section wherein each lower ladder section has an upper surface, a lower surface, a proximal end, a distal end, and opposing side rails. The upper ladder section is structured to hold the at least one lower ladder section captive as the lower surface of each of the at least one lower ladder sections is longitudinally displaced along the upper surface of an adjacent ladder section. An attachment mechanism is structured to attach the first proximal end of the upper ladder section to the proximal end of the housing mechanism.

The motorized ladder apparatus further includes a motorized deploying mechanism structured to controllably allow the ladder means to be pivotally and gravitationally deployed from the stowed configuration to a partially deployed configuration and to controllably allow the at least one lower ladder section to be longitudinally and gravitationally deployed from the partially deployed configuration to a fully deployed configuration, the motorized deploying mechanism including a motor-mounting mechanism mounted on the distal end of the housing mechanism, a motor mechanism mounted on the motor-mounting mechanism and having an output shaft, and a drive mechanism including a reel mechanism rotationally mounted to the motor-mounting mechanism, a connection mechanism connecting the reel mechanism to the output shaft of the motor mechanism, a pair of opposing first idler pulleys rotationally mounted to respective sides of the housing means, a pair of opposing second idler pulleys rotationally mounted to respective rails of the first ladder section, and a pair of opposing flexible members trained over respective first and second idler pulleys and connecting the reel mechanism to the second ladder section.

The motorized ladder apparatus also includes control means structured to control the motorized deploying mechanism, including a first sensing mechanism positioned to determine that the second proximal end of the second latter section has assumed the fully deployed configuration, a second sensing mechanism positioned to determine that the ladder means has assumed the stowed configuration, a switch mechanism having a neutral position, a deploy position, and a retract position wherein, as the ladder means is in the stowed configuration and the switch mechanism is toggled from the neutral position to the deploy position, the motor mechanism is activated to controllably allow the ladder means to be gravitationally deployed from the stowed configuration to the fully deployed configuration and the first sensing mechanism causes the motor mechanism to be automatically deactivated as the ladder means assumes the fully deployed configuration and wherein, as the ladder means is in the fully deployed configuration and the switch mechanism is toggled from the neutral position to the retract position, the motor mechanism is activated causing the pair of opposing flexible members to displace the ladder means from the fully deployed configuration to the stowed configuration and the second sensing mechanism causes the motor mechanism to be automatically deactivated as the ladder means assumes the stowed configuration. A power source provides electrical energy to the motor mechanism and to the control means.

The motorized ladder apparatus further includes a mechanical release mechanism, the activation of which allows the ladder apparatus to be gravitationally displaced from the stowed configuration to the fully deployed configuration during an electrical failure and also includes a braking mechanism that limits the rate at which the ladder apparatus is gravitationally displaced from the stowed configuration to the fully deployed configuration after the mechanical release mechanism has been activated.

PRINCIPAL OBJECTS AND ADVANTAGES OF THE INVENTION

The principal objects and advantages of the present invention include providing a motorized access apparatus; providing such a motorized access apparatus that has ladder sections that slide longitudinally relative to each other during deployment thereof; providing such a motorized access apparatus that includes a motor mechanism that controllably allows gravitational deployment of a ladder means thereof; providing such a motorized access apparatus that requires only approximately eighteen inches of space above an access opening for storage purposes; providing such a motorized access apparatus that can have two, three, or more ladder sections; providing such a motorized access apparatus that includes a mechanical release mechanism that allows deployment thereof during electrical failure; providing such a motorized access apparatus that includes a braking mechanism that limits the rate of deployment thereof in the event of electrical failure; and generally providing such a motorized access ladder that is reliable in performance, capable of long lasting life, and particularly well adapted for the proposed usages thereof.

Other objects and advantages of this invention will become apparent from the following description taken in conjunction with the accompanying drawings wherein are set forth, by way of illustration and example, certain embodiments of this invention.

DETAILED DESCRIPTION OF THE INVENTION

Figure 1:
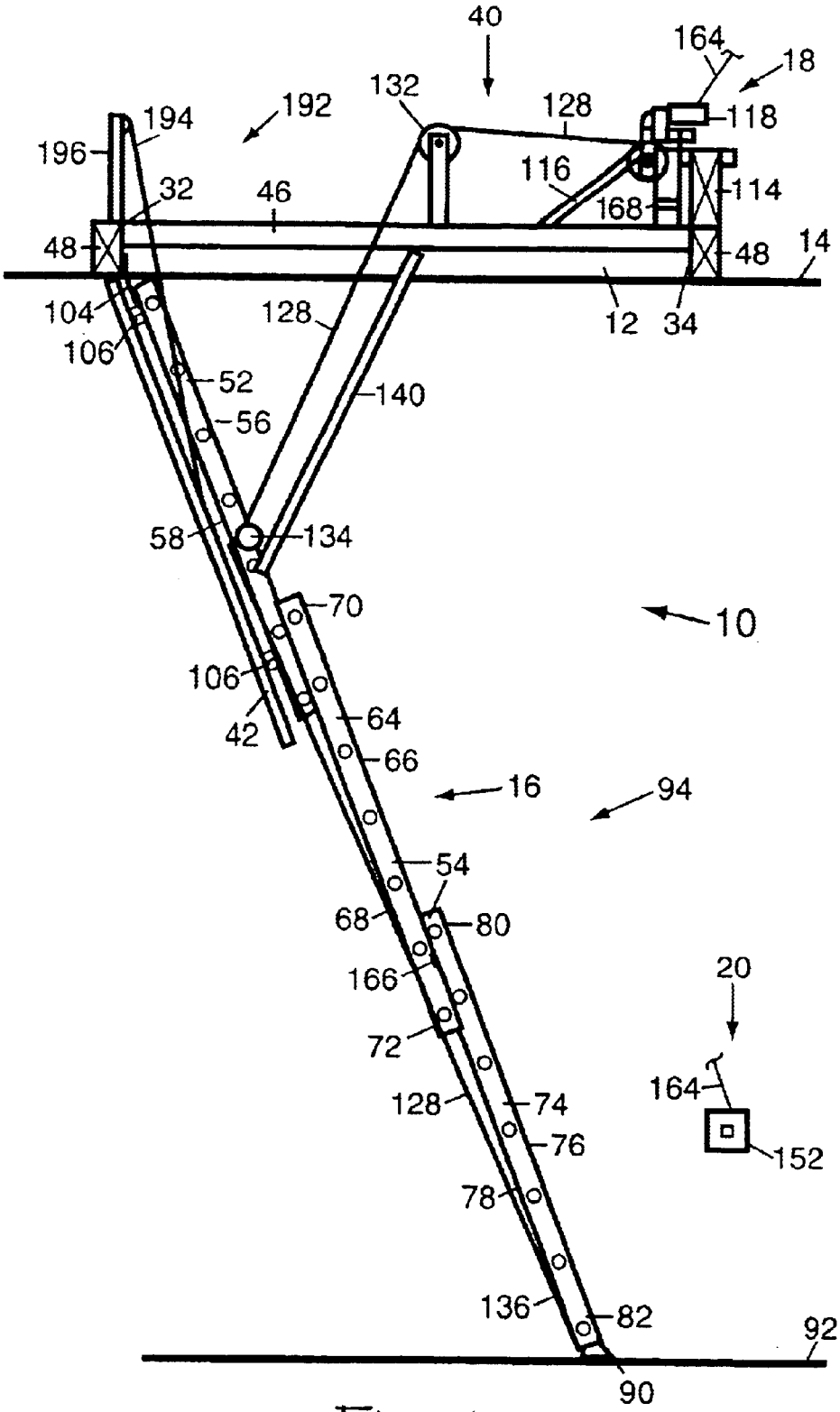
FIG. 1 is a side elevational and partially cross-sectional view of a motorized access ladder, showing a ladder means thereof in a fully deployed configuration, according to the present invention.

As required, embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

This disclosure is a continuation-in-part of U.S. patent application Ser. No. 10/670,202 filed Sep. 26, 2003, which disclosure is incorporated herein by reference.

The reference numeral 10 generally refers to a motorized access apparatus for elevated areas in accordance with the present invention, as shown in FIGS. 1 through 5.

The motorized access apparatus 10 includes housing means 12 secured to an elevated structure 14, ladder means 16 pivotally mounted to the housing means 12, motorized deploying means 18, and control means 20.

Figure 3:
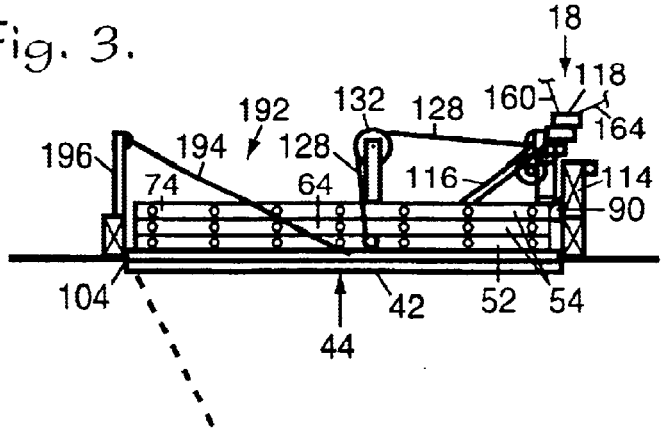
FIG. 3 is a side elevational and partially cross-sectional view of the motorized access apparatus showing the ladder means in a stowed configuration, according to the present invention.

The housing means 12 has a proximal end 32, a distal end 34, opposing sides 36, 38, a central opening 40 disposed between the proximal and distal ends 32, 34 and the opposing sides 36, 38, and a cover member 42 pivotally connected to the proximal end 32 of the housing means 12 and dimensioned to cover the central opening 40 as the motorized access apparatus assumes a stowed configuration 44, as shown in FIG. 3.

The housing means 12 may include a reinforcing means 46, such as angle iron portions or an angle iron frame for example, along the sides 36, 38 and/or proximal and distal ends 32, 34 of the housing means 12 for strengthening purposes. The housing means 12 may also include structural members 48 as needed between or along joists of the elevated structure 14 adjacent to the housing means 12.

The ladder means 16 includes an upper or first ladder section 52 and at least one lower ladder section 54. The first ladder section 52 has a first upper surface 56, a first lower surface 58, a first proximal end 60, and a first distal end 62. The at least one lower ladder section 54 includes a second ladder section 64 having second upper surface 66, a second lower surface 68, a second proximal end 70, and a second distal end 72. If the at least one lower ladder section 54 also includes a third ladder section 74, the third ladder section 74 has a third upper surface 76, a third lower surface 78, a third proximal end 80, and a third distal end 82.

Each ladder section 52, 64, 74 has opposing side rails 84, 86 and a plurality of rungs 88. The lowermost ladder section of the at least one lower ladder section 54 may include a pair of feet 90 pivotally mounted on distal ends of the side rails 84, 86 thereof to optimize contact between the lowermost ladder section of the at least one lower ladder section 54 and an underlying surface 92, such as the floor 92, when the motorized access apparatus 94 is in a fully deployed configuration 94, as shown in FIGS. 1 and 2.

The second ladder section 64 is held captive by the first ladder section 52 as the second lower surface 68 of the second ladder section 64 is displaced longitudinally along the first upper surface 56 of the first ladder section 52 similar to the captive relationship of other extension ladders, or other suitable arrangement. Similarly, if the at least one lower ladder section 54 includes the third ladder section 74, the third ladder section 74 is held captive by the second ladder section 64 as the third lower surface 78 of the third ladder section 74 is displaced longitudinally along the second upper surface 66 of second ladder section 64 as disclosed herein.

It is to be understood that due to the spacing between the elevated structure 14 and the underlying surface 92, some applications of the present invention may not require that the at least one lower ladder section 54 include the third ladder section 72. It is also to be understood that due to the spacing between the elevated structure 14 and the underlying surface 92, other applications may require that the at least one lower ladder section 54 include other ladder sections in addition to the second and third ladder sections 64, 74 as described herein. Regardless, whether a particular application requires fewer or more than three ladder sections, it is to be understood that all such applications lie within the spirit and scope of the present invention.

Figure 2:
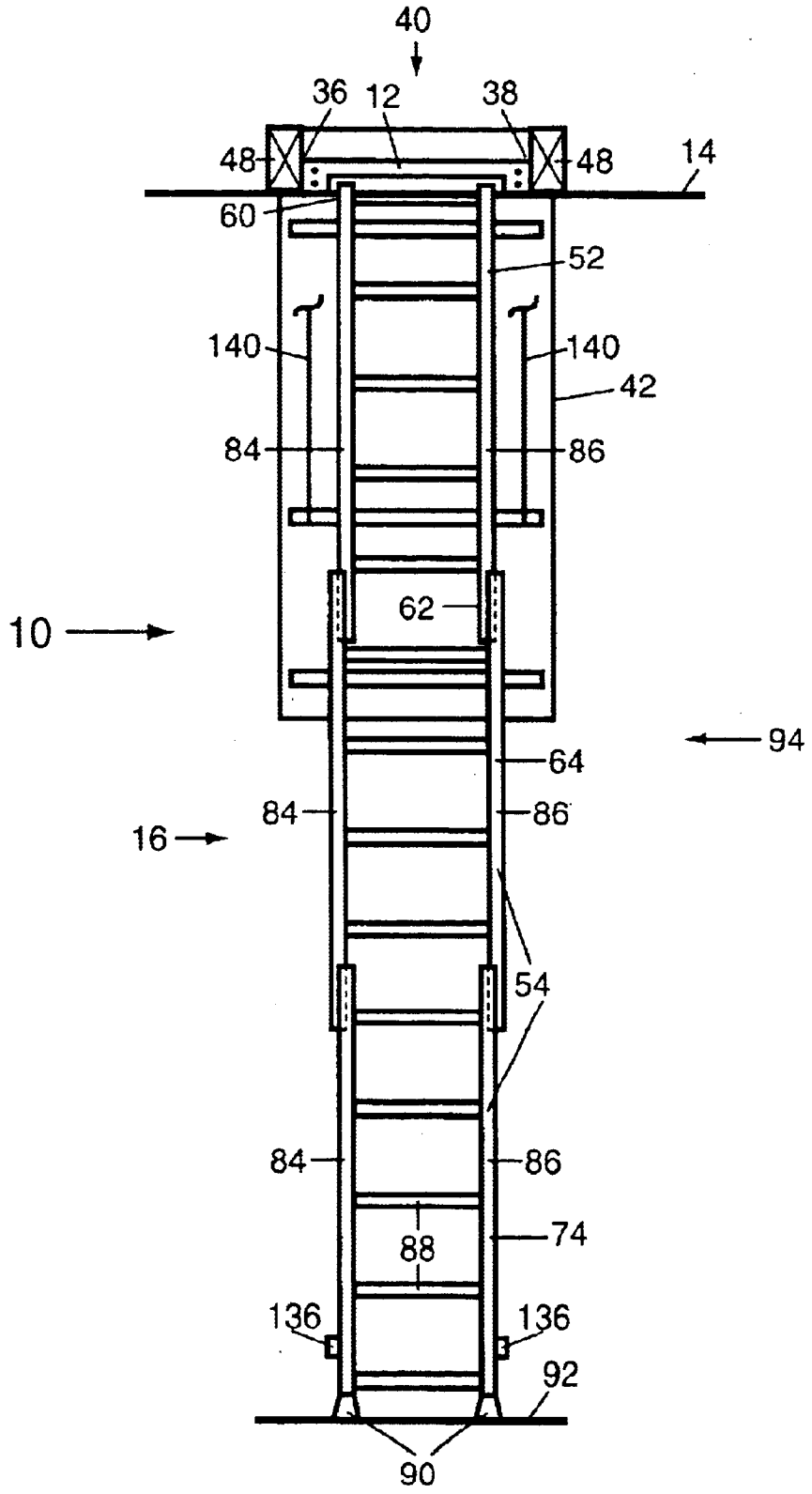
FIG. 2 is a front elevational and partially cross-sectional, fragmentary view of the motorized access apparatus, showing the ladder means in a fully deployed configuration, according to the present invention.

The motorized access apparatus 10 includes attachment means such as a pair of hinge-like first brackets 104 or other suitable attachment means, structured to pivotally attach the first proximal end 60 of the first ladder section 52 to the proximal end 32 of the housing means 12 as shown in FIG. 1, and second brackets 106 structured to fixedly secure the side rails 84, 86 of first ladder section 52 to the cover member 42 with fasteners such as bolts and nuts or other suitable fastening means.

Figure 4:
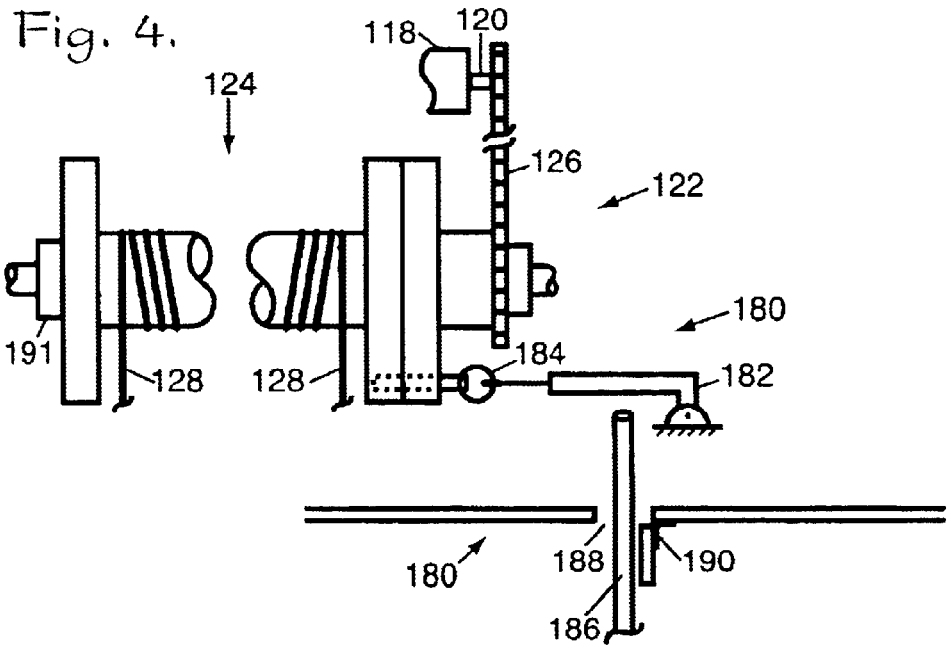
FIG. 4 is an enlarged schematic representation of a manual release mechanism and a braking mechanism of the motorized access apparatus, according to the present invention.

The motorized deploying means 18, which is structured to operatively displace the ladder means 16 to and from the stowed configuration 44 and the fully deployed configuration 94, includes a motor mounting mechanism 114 mounted at the distal end 34 of the housing mechanism 30. The motor mounting mechanism 114 may also include a pair of opposing brace members 116 secured to the sides 36, 38 of the housing means 12. The motorized deploying means 18 also includes an electric reversible motor mechanism 118 mounted on the motor mounting mechanism 114 and having an output shaft 120 and a drive mechanism 122, as shown in FIG. 4.

The drive mechanism 122 includes a reel mechanism 124 rotationally mounted to the motor mounting mechanism 114, a connecting mechanism 126 connecting the reel mechanism 124 to the output shaft 120 of the motor mechanism 118, and a pair of opposing flexible members 128 that connect the reel mechanism 124 to the ladder means 16.

Each of the pair of opposing flexible members 128 is trained over a respective one of a pair of opposing first idler pulleys 132 mounted on respective sides 36, 38 of the housing means 12, as shown in FIGS. 2 and 3. In addition, each of the pair of opposing flexible members 128 is trained over a respective one of a pair of opposing second idler pulleys 134 rotationally mounted on opposing sides of the rails 84, 86 of the first ladder section 52. Distal ends 136 of each of the pair of opposing flexible members 128 is connected to a respective one of the rails 84, 86 of the lowermost section of the lower ladder section 54 as shown in FIGS. 1 and 2.

Retainer means 140, such as a flexible strap or chain, is connected between one of the sides 36, 38 of the housing means 12 and either the cover member 42 or the first ladder section 52, as shown in FIGS. 1 and 2, to retain the ladder means 16 at an angular orientation that is generally accepted as being safe for ascent and descent thereof, such as approximately seventy degrees, as the ladder means 16 is positioned in the fully deployed configuration 94 and as the ladder means 16 is being displaced to and from a partially deployed configuration and the fully deployed configuration 94 as described herein. Preferably, the retainer means includes an opposing pair of the flexible strap or chain, each connected to a respective side 36, 38 of the housing means 12.

The control means 20, which is structured and configured to control the deploying means 18, includes a switch mechanism 152 having a neutral position 154, a deploy position 156, and a stow or retract position 158. For example, the switch mechanism 152 may include a double-pole, double-throw toggle switch 152 having a centrally located neutral position 154 wherein deployment of the elevated access apparatus 10 is selected when the switch 152 is toggled from the neutral position 154 to the deploy position 156, and stowing or retraction of the elevated access apparatus 10 is selected when the switch 152 is toggled from the neutral position 154 to the retract position 158. The switch mechanism 152 is installed at a location convenient for a user.

Figure 5:
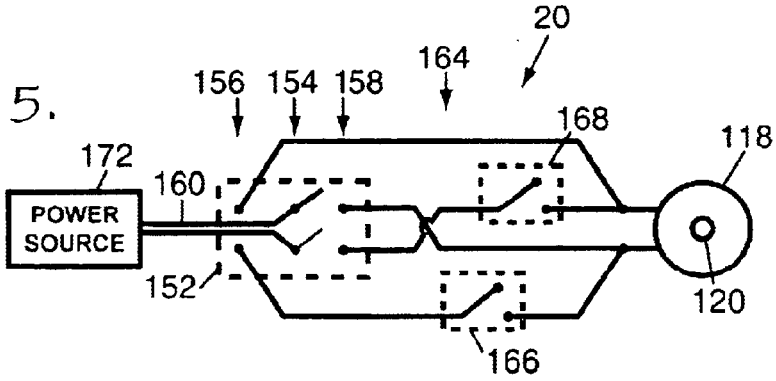
FIG. 5 is a schematic diagram of control circuitry of the motorized access apparatus, according to the present invention.

Electrical connections 160 connect the control means 20 and motor mechanism 118 to an electrical power source 172, such as a circuit of the elevated structure 14. Reversing circuitry 164 appropriately connect the switch mechanism 152 to the motor mechanism 118 to provide the reversing connections for the deploying and retracting properties of the control means 20 as indicated in FIG. 5.

The control means 20 also includes a first sensing mechanism 166 and a second sensing mechanism 168, such as push button switches, proximity switches or other suitable devices for example. The first sensing mechanism 166 is positioned to indicate when the lowermost ladder section of the at least one lower ladder section 54 has assumed the fully deployed configuration 94. If the at least one lower ladder section 54 has only the second ladder section 64, the first sensing mechanism 166 is located such that it is triggered when the second proximal end 70 of the second ladder section 64 reaches its fully deployed position. If the at least one lower ladder section 54 also includes the third ladder section 74, the first sensing mechanism 166 is located such that it is triggered when the third proximal end 80 of the third ladder section 74 reaches its fully deployed position as indicated in FIG. 1. The second sensing mechanism 168 is positioned to indicate when the motorized access apparatus 10 has assumed the stowed configuration 44.

In anticipation of the presence of electrical failure when it is desired to operate the motorized access apparatus 10, the motorized access apparatus 10 may include a mechanical release mechanism 180, such as a pivotally mounted L-shaped lever 182 that can be used to manually pull a release pin 184, such as with a slender elongate rod 186 inserted through a small opening 188 by a user standing on the underlying surface. Pulling the release pin 184 disconnects the reel mechanism 124 from the drive mechanism 122 and places the reel mechanism 124 in a free-wheeling mode that allows the access apparatus 10 to assume the fully deployed configuration 94 to thereby permit access to the overhead area even during the power failure. A small hinged access door 190 may be used to conceal the opening 188 for aesthetic purposes, if desired.

In the event that the mechanical release mechanism 180 has to be used and to prevent the ladder means 16 from suddenly gravitationally plunging downwardly to the fully deployed configuration 94, the motorized access apparatus 10 may include a braking mechanism 192, such as a magnetic brake or other suitable means, wherein the braking mechanism 192 is connected to the reel mechanism 124 to set an upper limit to the rate at which the reel mechanism 124 can feed out the flexible members 128 to thereby control the rate at which the ladder means 16 can descend downwardly during a power failure.

Alternately, or in addition to the mechanical release mechanism 180, the motorized access apparatus 10 may include a resilient mechanism 192 structured to, at least partially, counter the weight of the ladder means 16 as the ladder means 16 is gravitationally displaced downwardly, perhaps uncontrollably, from the stowed configuration 44. The resilient mechanism 192 includes a pair of opposing resilient members 194, such as a pair of coil springs or other suitable means. One end of each of the pair of opposing resilient members 194 is secured to a respective one of a pair of uprights 196 fixedly secured to the proximal end of the housing 12. The other end of each of the pair of opposing resilient members 194 is secured to either the upper ladder section 52 or the cover member 42 as indicated in FIGS. 1 and 3.

In an application of the present invention, the motorized access apparatus 10 is installed in a rectangular opening through a ceiling that provides access to an overhead storage area of a building structure with structural members 48 installed to provide necessary structural support for the opening. Normally, the motorized access apparatus 10 remains out of the way in the stowed configuration 44 until needed.

When the elevated access apparatus 10 is in the stowed configuration 44 and the switch mechanism 152 is toggled to the deploy position 156, the motor mechanism 118 is activated to thereby cause the pair of opposing flexible members 128 to be fed from the reel mechanism 124. As a result, the ladder means 16 is permitted to be pivotally and gravitationally lowered from the stowed configuration 44 at a controlled rate defined by the rate at which the motor mechanism 118 allows the pair of opposing flexible members 128 to be fed from the reel mechanism 124. When the ladder means reaches the angle permitted by the retainer means 140, sometimes referred to herein as a partially deployed configuration, and as the motor mechanism continues to allow the pair of opposing flexible members 128 to be fed from the reel mechanism 124, the at least one lower ladder section 54 continues to be gravitationally and controllably displaced longitudinally from the partially deployed configuration to the fully deployed configuration 94. If the at least one lower ladder section 54 includes the second ladder section 64 and also includes the third ladder section 74, the second ladder section 64 and the third ladder section 74 are simultaneously and gravitationally displaced in a side-by-side relationship from the partially deployed configuration to an intermediate configuration whereat the second ladder section 64 assumes its fully deployed position, whereupon the third ladder section 74 continues to be gravitationally and controllably displaced longitudinally until the upper ladder section 52 and all ladder sections of the at least one lower ladder section 54 are disposed in the fully deployed configuration 94 with the feet 90 resting against the underlying surface 92 whereupon the lowermost ladder section of the at least one lower ladder section 54 triggers the first sensing mechanism 166, thereby automatically deactivating the motor mechanism 118.

Conversely, when the elevated access apparatus 10 is in the fully deployed configuration 94 and the switch mechanism 152 is toggled to the retract position 158, the motor mechanism 118 is activated to thereby, via the pair of opposing flexible members 128, cause the at least one lower ladder section 54 to be retracted upwardly to the partially deployed configuration whereat the at least one lower ladder section 54 is positioned in a side-by-side relationship with the upper ladder section 52, whereupon the motor mechanism 118 continues retracting the side-by-side upper and at least one lower ladder sections 52, 54 from the partially deployed configuration until the motorized access apparatus 10 assumes the stowed configuration 44, whereat the second sensing mechanism 168 is triggered, automatically deactivating the motor mechanism 118.

One of the benefits of the motorized access apparatus 10 is the minimal volume of space required for storage thereof in the stowed configuration. Typically, the total space occupied by the motorized access apparatus 10 is a space approximately eighteen inches in height immediately above the central opening 40 that provides the through-access to the overhead area.

It is to be understood that while certain forms of the present invention have been illustrated and described herein, it is not to be limited to the specific forms or arrangement of parts described and shown.

What is claimed and desired to be covered by Letters Patent is as follows:

1. A ladder apparatus for providing access to an area over an elevated structure, comprising:

(a) a housing secured to the elevated structure, the housing having a proximal end, a distal end, opposing sides, and a central opening disposed between the proximal end, the distal end, and the opposing sides;

(b) a ladder pivotally mounted to the housing, the ladder including an upper ladder section and at least one lower ladder section mounted to the upper ladder section;

(c) a motorized deploying means for:

(1) controllably allowing the ladder to be pivotally and gravitationally deployed from a stowed configuration to a partially deployed configuration, (2) controllably allowing the at least one lower ladder section to be longitudinally and gravitationally deployed from the partially deployed configuration to a fully deployed configuration, (3) longitudinally retracting the at least one lower ladder section from the fully deployed configuration to the partially deployed configuration, and (4) pivotally retracting the ladder from the partially deployed configuration to the stowed configuration;

(d) control means for controlling the motorized deploying means; and (e) a power source providing electrical energy to the motorized deploying means and to the control means.

2. The ladder apparatus as described in claim 1, further comprising a pivotally mounted cover member, that is dimensioned to cover the central opening as the apparatus assumes the stowed configuration.

3. The ladder apparatus as described in claim 2 further comprising a flexible mechanism including:

(a) a pair of uprights secured to the proximal end of the housing; and (b) a pair of opposing flexible members, each having one end thereof secured to a respective one of the uprights and the other end thereof secured to either the upper ladder section or the cover member; and (c) wherein the flexible mechanism is structured to, at least partially, counter the weight of the ladder as the ladder is gravitationally displaced downwardly.

4. The ladder apparatus as described in claim 3, wherein the control means includes a switch mechanism having a neutral position, a deploy position, and a retract position, and wherein (a) as the ladder apparatus is disposed in the stowed configuration and the switch mechanism is toggled from the neutral position to the deploy position, the motorized deploying means is activated to controllably allow the ladder apparatus to be deployed from the stowed configuration to the fully deployed configuration, and (b) as the ladder apparatus is disposed in the fully deployed configuration and the switch mechanism is toggled from the neutral position to the retract position, the motorized deploying means is activated causing the pair of opposing flexible members to retract the ladder apparatus from the fully deployed configuration to the stowed configuration.

5. The ladder apparatus as described in claim 4, wherein the control means further includes a first sensing mechanism and a second sensing mechanism wherein:

(a) as the at least one lower ladder section reaches the fully deployed configuration, the first sensing mechanism causes the motorized deploying means to be automatically deactivated; and (b) as the ladder apparatus reaches the stowed configuration, the second sensing mechanism causes the motorized deploying means to be automatically deactivated.

6. The ladder apparatus as described in claim 1, wherein:

(a) the upper ladder section includes a first upper surface, a first lower surface, a first proximal end, and a first distal end; and (b) the at least one lower ladder section includes a second ladder section having a second upper surface, a second lower surface, a second proximal end, and a second distal end, wherein the second ladder section is connected to the upper ladder section such that the second lower surface of the second ladder section is longitudinally displaceable along the first upper surface of the upper ladder section.

7. The ladder apparatus as described in claim 6, wherein the at least one lower ladder section further includes a third ladder section having a third upper surface, a third lower surface, a third proximal end, and a third distal end, wherein the third ladder section is connected to the second ladder section such that the third lower surface of the third ladder section is longitudinally displaceable along the second upper surface of the second ladder section.

8. The ladder apparatus as described in claim 6, including an attachment mechanism structured to pivotally attach the first proximal end of the upper ladder section to the proximal end of the housing.

9. The ladder apparatus as described in claim 1, wherein the motorized deploying means includes:

(a) a motor mounting mechanism mounted on the distal end of the housing;

(b) a motor mechanism mounted on the motor mounting mechanism and having an output shaft; and (c) a drive mechanism connecting the output shaft to the ladder.

10. The ladder apparatus as described in claim 9, wherein the drive mechanism includes:

(a) a reel mechanism, (b) a connecting mechanism connecting the reel mechanism to the output shaft of the motor mechanism, and (c) a pair of opposing flexible members connecting the reel mechanism to the at least one lower ladder section.

11. The ladder apparatus as described in claim 1 further comprising a mechanical release mechanism, the activation of which allows the ladder apparatus to be gravitationally displaced from the stowed configuration to the fully deployed configuration during an electrical failure.

12. The ladder apparatus as described in claim 11 further comprising a braking mechanism that limits the rate at which the ladder apparatus is gravitationally displaced from the stowed configuration to the fully deployed configuration after the mechanical release mechanism has been activated.

13. The ladder apparatus as described in claim 1 further comprising retaining means wherein the ladder is retained at a predetermined angle as the ladder assumes the partially deployed configuration and as the at least one ladder section is being displaced to and from the partially deployed configuration and the fully deployed configuration.

14. A ladder apparatus for providing access to an area over an elevated structure, comprising:

(a) a housing secured to the elevated structure, the housing having a proximal end, a distal end, opposing sides, a central opening disposed between the proximal and distal ends and opposing sides, and a cover member pivotally connected to the proximal end of the housing and dimensioned to cover the central opening as the apparatus assumes a stowed configuration;

(b) a ladder, including:

(1) an upper ladder section having a first upper surface, a first lower surface, a first proximal end, a first distal end, and opposing side rails;

(2) a second ladder section having a second upper surface, a second lower surface, a second proximal end, a second distal end, and opposing side rails, wherein the first ladder section is structured to hold the second ladder section captive as the second lower surface of the second ladder section is longitudinally displaced along the first upper surface of the first ladder section;

(c) an attachment mechanism structured to attach the first proximal end of the first ladder section to the proximal end of the housing;

(d) a motorized deploying means for controllably allowing the ladder to be pivotally and gravitationally deployed from the stowed configuration to a partially deployed configuration and for controllably allowing the second ladder section to be longitudinally and gravitationally deployed from the partially deployed configuration to a fully deployed configuration, the motorized deploying means including:

(1) a motor-mounting mechanism mounted on the distal end of the housing, (2) a motor mechanism mounted on the motor-mounting mechanism and having an output shaft, and (3) a drive mechanism including:

(A) a reel mechanism rotationally mounted to the motor-mounting mechanism, (B) a connection mechanism connecting the reel mechanism to the output shaft of the motor mechanism, (C) a pair of opposing first idler pulleys rotationally mounted to respective sides of the housing, (D) a pair of opposing second idler pulleys rotationally mounted to respective rails of the first ladder section, and (E) a pair of opposing flexible members respectively trained over the pairs of first and second idler pulleys and connecting the reel mechanism to the second ladder section;

(e) control means for operatively controlling the motorized deploying means, including:

(1) a first sensing mechanism positioned to determine that the second proximal end of the second ladder section has assumed the fully deployed configuration;

(2) a second sensing mechanism positioned to determine that the ladder apparatus has assumed the stowed configuration;

(3) a switch mechanism having a neutral position, a deploy position, and a retract position, wherein (A) as the ladder apparatus is in the stowed configuration and the switch mechanism is toggled from the neutral position to the deploy position:

(i) the motorized deploying means is activated to controllably allow the ladder apparatus to be gravitationally deployed from the stowed configuration to the fully deployed configuration, and (ii) the first sensing mechanism causes the motorized deploying means to be automatically deactivated as the ladder apparatus assumes the fully deployed configuration, and (B) as the ladder apparatus is in the fully deployed configuration and the switch mechanism is toggled from the neutral position to the retract position:

(i) the motorized deploying means is activated causing the pair of opposing flexible members to displace the ladder apparatus from the fully deployed configuration to the stowed configuration, and (ii) the second sensing mechanism causes the motorized deploying means to be automatically deactivated as the ladder apparatus assumes the stowed configuration;

(g) a power source providing electrical energy to the motorized deploying means and to the control means;

(h) a mechanical release mechanism, the activation of which allows the ladder apparatus to be gravitationally displaced from the stowed configuration to the fully deployed configuration during an electrical failure;

(i) a braking mechanism that limits the rate at which the ladder apparatus is gravitationally displaced from the stowed configuration to the fully deployed configuration after the mechanical release mechanism has been activated; and (j) flexible mechanism including:

(1) a pair of uprights secured to the proximal end of the housing; and (2) a pair of opposing flexible members, each having one end thereof secured to a respective one of the uprights and the other end thereof secured to either the upper ladder section or the cover member; and (3) wherein the flexible mechanism is structured to, at least partially, counter the weight of the ladder apparatus as the ladder apparatus is gravitationally displaced downwardly.

* * * * *